US007043785B2

(12) United States Patent
Dimentmen

(10) Patent No.: US 7,043,785 B2
(45) Date of Patent: May 16, 2006

(54) COMPACT FOLDABLE STRETCHER

(76) Inventor: Nehemya Dimentmen, 20 Migdal Eder Street P.O. Box 671, Newe Daniel 90909 (IL)

( * ) Notice: Subject to any disclaimer, the term of this patent is extended or adjusted under 35 U.S.C. 154(b) by 13 days.

(21) Appl. No.: 10/506,235

(22) PCT Filed: Mar. 9, 2003

(86) PCT No.: PCT/IL03/00190

§ 371 (c)(1),
(2), (4) Date: May 23, 2005

(87) PCT Pub. No.: WO03/075817

PCT Pub. Date: Sep. 18, 2003

(65) Prior Publication Data

US 2005/0210589 A1 Sep. 29, 2005

(30) Foreign Application Priority Data

Mar. 14, 2002 (IL) ..... 148694

(51) Int. Cl.
*A61G 1/013* (2006.01)

(52) U.S. Cl. ..... 5/627; 5/625; 5/111

(58) Field of Classification Search ..... 5/625–627, 5/110, 111

See application file for complete search history.

(56) References Cited

U.S. PATENT DOCUMENTS 2,133,692 A * 10/1938 Gittings et al. ..... 5/627

(Continued)

*Primary Examiner*—Michael Trettel

(74) *Attorney, Agent, or Firm*—Lerner, David, Littenberg, Krumholz & Mentlik, LLP

(57) ABSTRACT

The invention provides a foldable stretcher, comprising a first pair of axially-alignable rigid longitudinal members (12), each member (12) having arm inner and an outer extremity (14, 16) and being hingedly connected (18) at its inner extremity (14) to its adjacent member (12) by a longitudinal linkage (20, 20*a*); a second pair of axially-alignable rigid longitudinal members (12*a*), each member having an inner (14*a*) and an outer (16*a*) extremity and also being hingedly connected at its inner extremity (14*a*) to its adjacent member (12*a*) by a longitudinal linkage (20*a*), the pairs of longitudinal members (12) being interconnected in spaced-apart array by a flexible web (22) suspended therebetween; and four longitudinal carrier handle members (24), each having an outer extremity (26) configured for grasping and lifting, and each having an inner extremity hingedly (36) connected to one of the outer extremities (16) of the longitudinal members (12, 12*a*) by means of a link member (38), and each of handle members (24) being provided with a depending leg (30), the four legs (30) being configured to support the stretcher (10) when the stretcher is in its deployed configuration and each of the legs (30) being provided with an open U-shaped bottom (32) sized to receive within its confines and override a segment of the respective longitudinal member (12, 12*a*) to which each of the carrier handles (24) are attached; and at least two spaced-apart collapsible strut members (40) configured to maintain a predetermined lateral space between the pairs of longitudinal members (12, 12*a*) when the stretcher is in its deployed state; whereby the stretcher can be collapsed into a compact volume by collapsing the strut members (40), folding the carrier handles (24) 180' relative to the respective longitudinal member (12, 12*a*) to which they are hingedly connected wherein the open U-shaped bottoms (32) of each of the legs (30) engages the respective longitudinal member (12, 12*a*) to which the carrier handles (24) are attached, and folding the members (12, 12*a*) of each of the pairs of longitudinal members 180° relative to each other.

3 Claims, 2 Drawing Sheets

U.S. PATENT DOCUMENTS 2,378,809 A * 6/1945 Thomson et al. ..... 5/627
2,650,373 A 9/1953 Zeller et al.
2,722,690 A 11/1955 Donargo
3,417,412 A * 12/1968 Andrews ..... 5/627
3,886,606 A 6/1975 Bradford
4,685,161 A * 8/1987 Zalman ..... 5/627
4,799,274 A 1/1989 Dommerud
5,283,919 A 2/1994 Grant

* cited by examiner

COMPACT FOLDABLE STRETCHER

The present invention relates to a foldable stretcher.

More particularly, the invention provides a foldable, easily portable stretcher which when deployed is sufficiently large for the evacuation of an adult and when folded is sufficiently compact to be carried conveniently as a backpack.

As is known, stretchers are used for evacuating wounded or ill persons to a safe area or to an ambulance, and then to hospital if needed. When deployed, a stretcher will typically measure more than two meters in length and about 55 cm in width. As stretchers need to be: quickly transported to the place of use, typically the battlefield, to the site of a life-threatening disaster such as a fire or a collapsed building, and into buildings served by medical emergency services, it has long been clear that a stretcher needs to be lightweight, strong, and foldable, as well as very quickly and easily erectable. To meet this need, stretchers having multiple fold lines have been developed. Such stretchers are readily transported in the folded state, and are sufficiently compact to allow a medic or any rescue crewmember to carry a folded stretcher by hand or on the back.

In U.S. Pat. No. 4,799,274 Dommerud discloses a stretcher described as foldable. However only the width dimension can be reduced, and after "folding" the device remains about 2 meters long.

The folding trauma stretcher disclosed by Grant in U.S. Pat. No. 5,283,919 can be folded for storage along one central axis. The design described has too many features to be sufficiently lightweight for convenient carrying by one person, and the width cannot be reduced by folding.

With regard to the legs of a stretcher, these are necessary to prevent the occupant, in effect uncomfortably lying on the ground when the stretcher is put down. Stretchers are known wherein said legs are rigidly attached to the longitudinal members, resulting in a larger space envelope for the folded stretcher. Furthermore, little has been done to reduce the weight of these essential structural items.

It is therefore one of the objects of the present invention to obviate the disadvantages of prior-art stretchers and to provide an improved arrangement for folding/deploying said legs.

Yet a further object of the present invention is to, provide a high-strength full size stretcher weighing less than 7 kg.

The present invention achieves the above objects by providing a foldable stretcher, comprising:

a) a first pair of axially-alignable rigid longitudinal members, each member having an inner and an outer extremity and being hingedly connected at its inner extremity to its adjacent member by a longitudinal linkage, and a second pair of axially-alignable rigid longitudinal members, each member having an inner and an outer extremity and also being hingedly connected at its inner extremity to its adjacent member by a longitudinal linkage, the pairs of longitudinal members being laterally interconnected in spaced-apart array by a flexible web suspended therebetween;

b) four longitudinal carrier handle members, each having an outer extremity configured for grasping and lifting, and each having an inner extremity hingedly connected to one of said outer extremities of said longitudinal members by means of a link member, and each of handle members being provided with a depending leg, said four legs being configured to support said stretcher when said stretcher is in its deployed configuration and each of said legs being provided with an open U-shaped bottom sized to receive within its confines and override a segment of the respective longitudinal member to which each of said carrier handles are attached, and c) at least two spaced-apart collapsible strut members configured to maintain a predetermined lateral space between said pairs of longitudinal members when said stretcher is in its deployed state; whereby said stretcher can be collapsed into a compact volume by collapsing said strut members, folding said carrier handles 180° relative to the respective longitudinal member to which they are hingedly connected wherein said open. U-shaped bottoms of each of said legs engages the respective longitudinal member to which said carrier handles are attached, and folding the members of each of said pairs of longitudinal members 180° relative to each other.

In a preferred embodiment of the present invention there is provided a foldable stretcher wherein the rigid longitudinal members are made of high strength aluminium alloy tubing.

It will thus be realized that the novel stretcher of the present invention has several fold lines which serve to achieve a compact package suitable for convenient transport on the back of a single person. The leg members engage and overlap the longitudinal members therefore allowing for compactness not achievable in previous configurations.

Prototypes of the stretcher have been built and tested. The weight of the prototype is 5 kg, and its largest dimension when fully folded is 45 cm.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
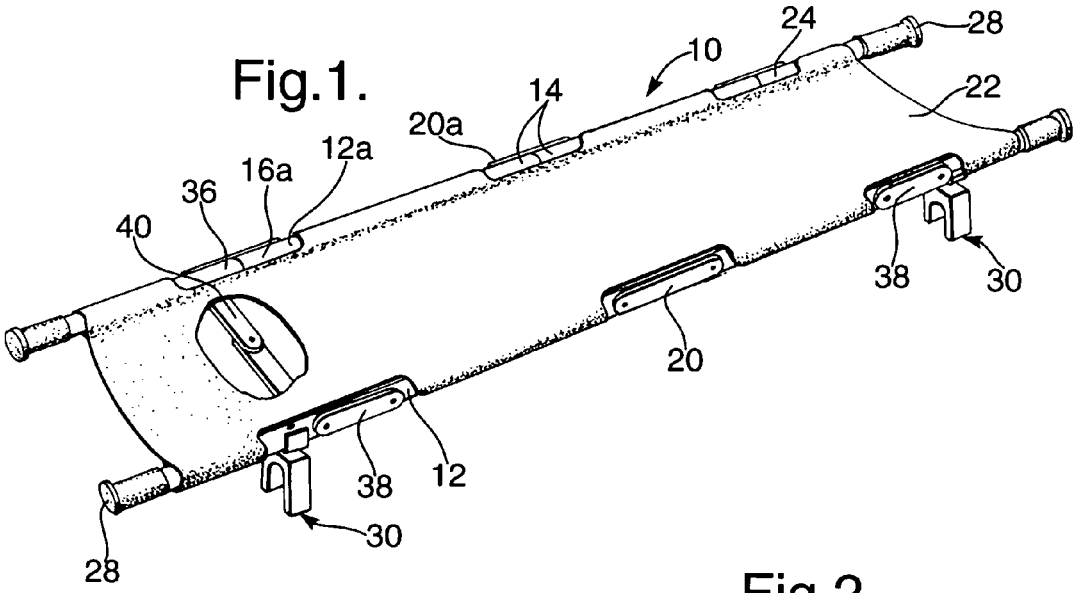
FIG. 1 is a perspective, fragmented view of a preferred embodiment of the stretcher according to the invention shown in its deployed state.

There is seen in FIG. 1 a foldable stretcher 10 in its deployed state.

The main frame comprises two pairs of axially-alignable rigid longitudinal members 12. Each longitudinal member 12 has an inner and an outer extremity 14, 16, seen best in FIG. 2, and is hingedly connected 18 at its inner extremity 14 to its adjacent member 12 by a longitudinal linkage 20 and 20*a*. A second pair of axially-alignable rigid longitudinal members 12*a*, each member also having an inner 14*a* and an outer 16*a* extremity is also hingedly connected at its inner extremity 14*a* to its adjacent member 12*a* by a longitudinal linkage 20*a*.

The rigid longitudinal members 12, 12*a* are suitably made of high strength round aluminium alloy tubing, typically aluminium alloy 6063-T5. However where the stretcher is intended for airplane or helicopter use, some extra cost can be justified to effect further weight savings, which can be achieved by manufacturing the rigid longitudinal members 12, 12*a* of plastic carbon-fiber-reinforced tube, magnesium or titanium.

The pairs of longitudinal members 12 are interconnected by a flexible web, such as standard canvas, 22 securely suspended therebetween.

Two pairs of spaced-apart collapsible strut members 40 (only a part of one pair is seen in the figure) are configured to maintain a predetermined lateral space between the pairs of longitudinal members 12, 12*a* to tension the canvas 22 when the stretcher is in its deployed state. The stretcher can be folded into a compact volume after collapsing the strut members 40.

Figure 2:
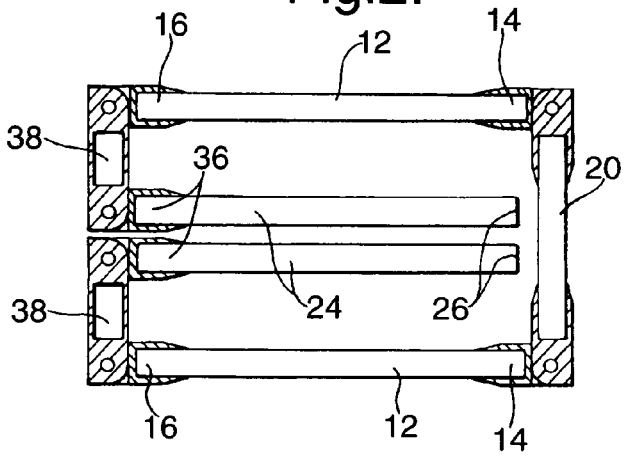
FIG. 2 is a sectional view of the frame of the same embodiment in its folded state.

Four longitudinal carrier handle members 24 each have an outer extremity 26, seen in FIG. 2, configured for grasping and lifting. Advantageously a rubber handle sleeve 28 is fitted over the outer extremity to reduce localized pressure on the hand when the stretcher 10 is deployed and loaded.

Figure 3:
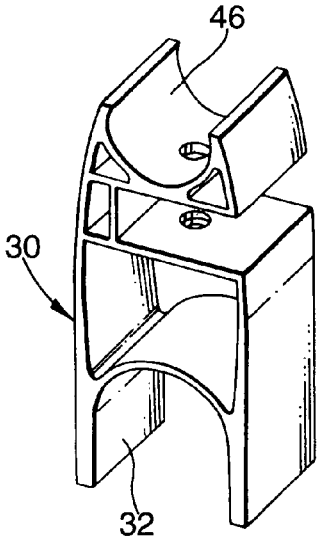
FIG. 3 is a detail perspective view of one of the stretcher legs.

Each handle member is provided with a depending leg 30, seen to best effect in FIG. 3. The four legs 30 are configured to support the stretcher 10 when the stretcher is in its deployed configuration. Each leg 30 has an open U-shaped bottom 32, the purpose of which is evident by glancing at FIG. 4. In the shown embodiment the leg 30 is rigidly attached to handle member 24 by means of a fastener 34 seen in FIG. 4.

The inner extremity 36 seen in FIG. 2, of the carrier handle member 24 is hingedly connected to one of the outer extremities 16 of the longitudinal members 12, 12*a* by means of a link member 38.

With regard to the rest of the figures, similar reference numerals have been used to identify similar parts.

Referring now to FIG. 2, there is seen the frame of the stretcher in its folded state, before attachment of the legs 30. It is to be noted that both longitudinal members 12, and the carrier handle members 24 are all substantially of equal length. Considering also that the linkages 20 and 38 contribute to the deployed length of the stretcher but not to its folded length, the result is that although the stretcher is over 2 meters long when deployed, its folded length is less than a ¼ of the fully deployed length.

The stretcher can be quickly be collapsed into the compact volume shown in FIG. 2 by a 3-stage action:

1. Collapsing the strut members 40, one pair being seen in FIG. 1.
2. Folding the carrier handles 24 180° relative to the respective longitudinal member 12, 12*a* to which they are hingedly connected.
3. Folding the members 12, 12*a* of each of the pairs of longitudinal members 180° relative to each other.

The largest dimension of the compact folded volume is less than 65 cm, and when carefully designed can be reduced to 45 cm.

A trained medic can deploy or fold the stretcher in less than 10 seconds.

Turning now to FIG. 3, one of the stretcher legs 30 is seen in detail. The leg is made of an aluminium extrusion, and is drilled to suit the fastener 34 seen in FIG. 4. The U-shaped bottom 32 straddles the longitudinal member 12 or 12*a* when the stretcher is folded and supports the stretcher above ground level when the stretcher is deployed.

Figure 4:
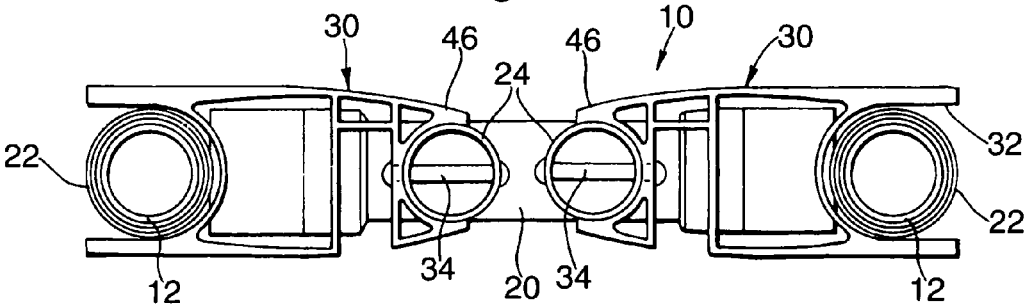
FIG. 4 is an end view of the folded frame and two of its legs.

FIG. 4 shows the folded frame seen previously in FIG. 2, after attachment of its legs 30. The upper semi-cylindrical section 46 is rigidly attached to the carrier handle 24 by fastener 34.

Figure 5:
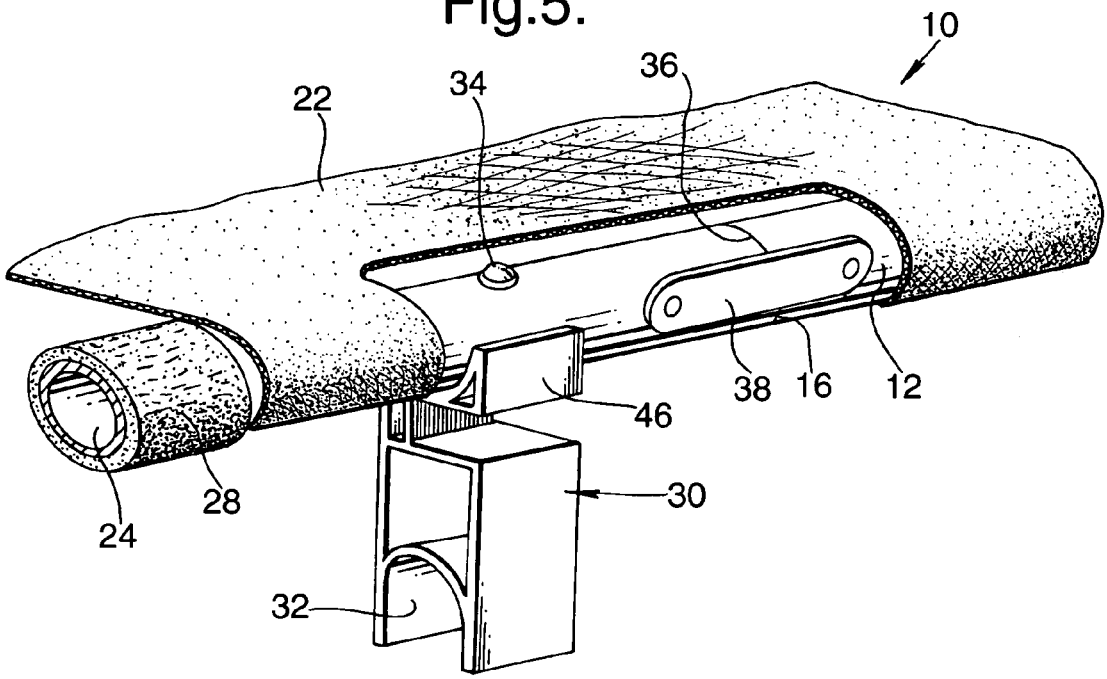
FIG. 5 is a detail perspective view of one of the deployed legs.

Referring now to FIG. 5, there is seen the deployed leg 30 in detail.

Figure 6:
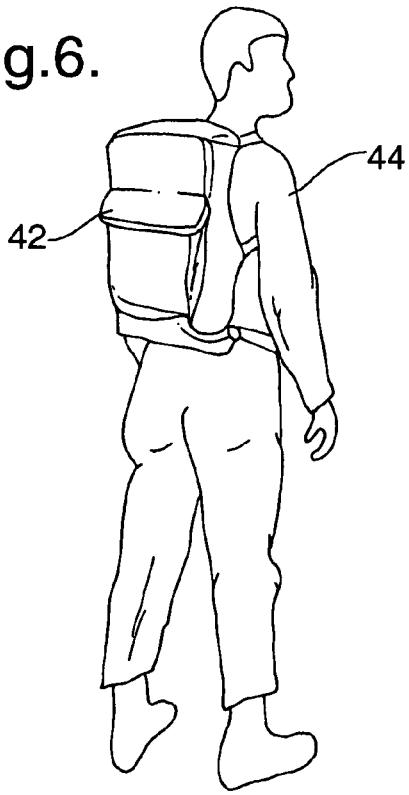
FIG. 6 is a pictorial view of the stretcher in a carrier bag arranged as a backpack.

FIG. 6 illustrates the folded stretcher in a carrier bag 42 arranged as a backpack. Due to the compact dimensions of the folded stretcher, the medic 44 carrying same is able to move freely, as needed in emergencies.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A foldable stretcher, comprising:

a) a first pair of axially-alignable rigid longitudinal members, each member having an inner and an outer extremity and being hingedly connected at its inner extremity to its adjacent member by a longitudinal linkage, and a second pair of axially-alignable rigid longitudinal members, each member having an inner and an outer extremity and also being hingedly connected at its inner extremity to its adjacent member by a longitudinal linkage, said pairs of longitudinal members being interconnected in spaced-apart array by a flexible web suspended therebetween;

b) four longitudinal carrier handle members, each having an outer extremity configured for grasping and lifting, and each having an inner extremity hingedly connected to one of said outer extremities of said longitudinal members by means of a link member, and each of handle members being provided with a depending leg, said four legs being configured to support said stretcher when said stretcher is in its deployed configuration and each of said legs being provided with an open U-shaped bottom sized to receive within its confines and override a segment of the respective longitudinal member to which each of said carrier handles are attached; and c) at least two spaced-apart collapsible strut members configured to maintain a predetermined lateral space between said pairs of longitudinal members when said stretcher is in its deployed state; whereby said stretcher can be collapsed into a compact volume by collapsing said strut members, folding said carrier handles 180° relative to the respective longitudinal member to which they are hingedly connected wherein said open U-shaped bottoms of each of said legs engages the respective longitudinal member to which said carrier handles are attached, and folding the members of each of said pairs of longitudinal members 180° relative to each other.

2. A foldable stretcher according to claim 1 wherein the largest dimension of said compact volume is less than 65 cm.

3. A foldable stretcher according to claim 1, wherein said rigid longitudinal members are made of high strength aluminium alloy tubing.

* * * * *